US012385222B2

(12) United States Patent
Ho et al.

(10) Patent No.: US 12,385,222 B2
(45) Date of Patent: Aug. 12, 2025

(54) POWERTRAIN ECO-MODE FOR WORK MACHINES

(71) Applicant: Caterpillar Inc., Peoria, IL (US)

(72) Inventors: Aaron Y Ho, Naperville, IL (US); John J Krone, Peoria, IL (US); Jordan A. Mangels, Peoria, IL (US); Jeremy D. Folkerts, Naperville, IL (US); Mehul Yadav, Aurora, IL (US)

(73) Assignee: Caterpillar Inc., Peoria, IL (US)

( * ) Notice: Subject to any disclaimer, the term of this patent is extended or adjusted under 35 U.S.C. 154(b) by 265 days.

(21) Appl. No.: 17/890,021

(22) Filed: Aug. 17, 2022

(65) Prior Publication Data

US 2024/0060269 A1 Feb. 22, 2024

(51) Int. Cl.
*E02F 9/20* (2006.01)
*E02F 9/22* (2006.01)

(52) U.S. Cl.
CPC ..... *E02F 9/2079* (2013.01); *E02F 9/2253* (2013.01)

(58) Field of Classification Search
None
See application file for complete search history.

(56) References Cited

U.S. PATENT DOCUMENTS

| | | | | |
|---|---|---|---|---|
| 4,495,576 | A | 1/1985 | Ito | |
| 4,507,736 | A | 3/1985 | Klatt | |
| 4,843,551 | A | 6/1989 | Milunas | |
| 5,040,648 | A | 8/1991 | Mitchell | |
| 5,050,456 | A | 9/1991 | Fukuda | |
| 5,467,854 | A | 11/1995 | Creger | |
| 8,855,870 | B2 | 10/2014 | Hyodo | |
| 9,079,575 | B2 | 7/2015 | Ho | |
| 2007/0056793 | A1* | 3/2007 | Yanagihara | F16H 59/042 180/336 |
| 2012/0226422 | A1* | 9/2012 | Jacobson | F16H 61/0213 701/58 |
| 2014/0135172 | A1* | 5/2014 | Ho | B60W 10/026 477/109 |
| 2016/0348785 | A1* | 12/2016 | Patenaude | F16H 61/0213 |
| 2018/0134303 | A1* | 5/2018 | Lister | B60W 30/188 |
| 2019/0299994 | A1* | 10/2019 | Awana | B60W 10/10 |
| 2022/0176946 | A1* | 6/2022 | McKinzie | B60W 10/02 |

* cited by examiner

*Primary Examiner* — James J Lee
*Assistant Examiner* — Melanie G Huber

(57) ABSTRACT

A work machine having a powertrain, an engine, a torque converter operably connected to the engine, a transmission, a selector interface, and a control system. The control system is configured to: receive a machine activation signal from the selector interface indicative of operation of the work machine; receive machine conditions to determine an optimal gear for next pass; and send a gear pass signal to command execution of a directional shift and a speed shift simultaneously when a gear ratio setting of the transmission is indicative of a second gear ratio.

20 Claims, 5 Drawing Sheets

POWERTRAIN ECO-MODE FOR WORK MACHINES

TECHNICAL FIELD

The present disclosure relates generally to a powertrain of a work machine, and more particularly relates to a control system for a powertrain system of the work machine.

BACKGROUND

A compactor is adapted to compact a material to a desired density. The compactor may be a landfill compactor or a soil compactor. Examples of applications include, but are not limited to, construction sites to prevent natural settling of the ground, landfill sites to compact the landfill waste into as small a volume as possible, and blacktop roads and parking lots, to prevent settling of the blacktop, and hence prevent future cracking of the road or the parking lots.

The landfill compactor is propelled by a powertrain having an engine connected to a transmission via a torque converter. One characteristic of torque converters is their ability to multiply torque when there is a difference between the input speed to the converter from the engine and the output speed of the converter to the transmission. Some torque converters also include a locking mechanism that transfers engine speed directly to the transmission with no substantial torque multiplication or speed variation. The landfill compactor may be desired to run in a first or second gear transmission ratio for efficient fuel management. Further, the use of torque converter in the second gear transmission ratio may overheat the torque converter due to heavy loading conditions while on an inclination and lead to inefficiency of the landfill compactor and loss of fuel economy during gear to gear shifting.

U.S. Pat. No. 5,467,854 discloses a method of controlling clutch-to-clutch shifts for a transmission including a plurality of speed and direction changing clutches to produce a shift from a first transmission ratio to a second transmission ratio through disengagement of an off-going clutch associated with the first transmission ratio and engagement of an on-coming clutch associated with the second transmission ratio. During an upshift, the direction clutch is disengaged, then re-engaged after the on-coming speed clutch is engaged.

It can therefore be seen that a need exists for an improved control strategy that utilizes a work machine's conditions, in a particular inclination grade, to perform a directional shift and a speed shift simultaneously when executing a gear shift.

SUMMARY OF THE DISCLOSURE

In accordance with one aspect of the disclosure, a work machine having a powertrain, an engine, a torque converter operably connected to the engine, a transmission, a selector interface, and a control system. The control system is configured to: receive a machine activation signal from the selector interface indicative of operation of the work machine; receive current machine conditions to determine an optimal gear for next pass; and send a gear pass signal to command execution of a directional shift and a speed shift when a gear ratio setting of the transmission is indicative of a second gear ratio.

In accordance with another aspect of the disclosure, a method for operating a work machine having a powertrain, the powertrain including an engine operably connected to a torque converter, a torque converter connected to a transmission, and a selector interface is disclosed. The method comprises: activating operation of the machine via the selector interface; receiving machine conditions by a control system to determine an optimal gear for next pass; and sending a gear pass signal by the control system to command execution of a directional shift and a speed shift simultaneously when a gear ratio setting of the transmission is indicative of a second gear ratio.

In accordance with another aspect of the disclosure, a work machine powertrain is disclosed. The work machine powertrain comprises: an engine operably connected to a torque converter, the torque converter connected to a transmission, and a control system. The control system is configured to: receive powertrain conditions to determine an optimal gear for next pass; and send a gear pass signal to command execution of a directional shift and a speed shift simultaneously when a gear ratio setting of the transmission is indicative of a second gear ratio.

These and other aspects and features of the present disclosure will be better understood upon reading the following detailed description when read in conjunction with the accompanying drawings.

DETAILED DESCRIPTION

Figure 1:
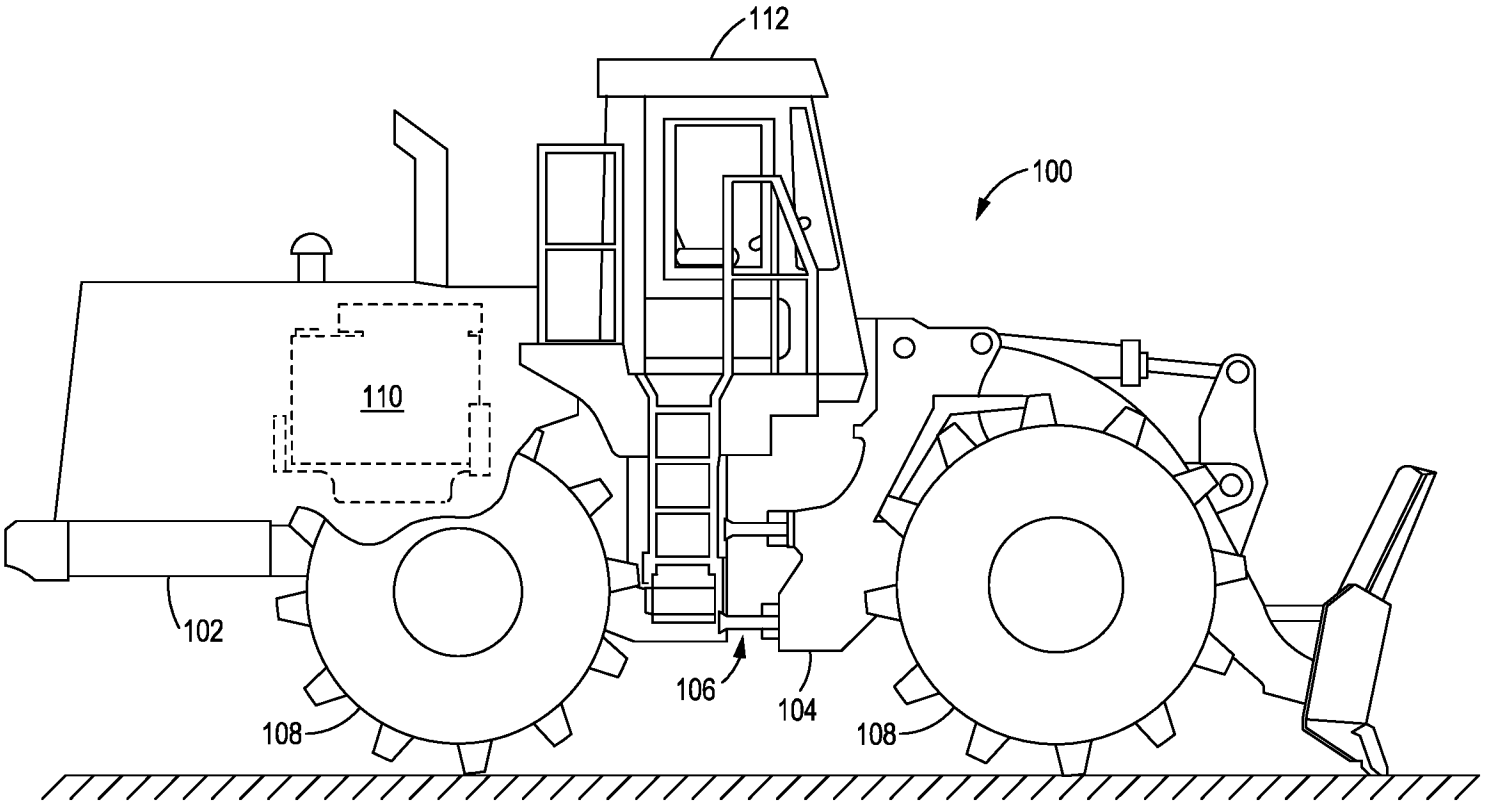
FIG. 1 is a side view of a work machine, according to an embodiment of the present disclosure

This disclosure generally relates to a powertrain of a machine having a transmission and, more particularly, to the powertrains that includes a torque converter capable of directly and selectively linking an output of an engine with the transmission. FIG. 1, in one embodiment, displays a side view of a work machine 100 illustrated as a landfill compactor, in which various embodiments of the present disclosure may be implemented. In the illustrated embodiment, the work machine 100 may include an engine frame portion 102 connected to a non-engine frame portion 104 by an articulated joint 106. Further, a set of ground engaging elements 108, such as a set of wheels, may support the engine frame portion 102 and the non-engine frame portion 104 on ground. The engine frame portion 102 includes an engine 110 to provide power to the ground engaging elements 108. The work machine 100 further includes an operator station 112 that houses various control devices which can be operated manually by an operator in the operator station 112 or autonomously. While the work machine 100 depicted and described as a landfill compactor, it is to be understood that the teachings of this disclosure applies to other work machines as well, including, but not limited to, excavators, track type tractors, backhoes, cranes, skid steers, wheel loaders, tractors, and mulchers, and the like Now referring to FIG. 2, in one embodiment, the work machine 100 may include one or more operator interface devices 114 located in the operator station 112. The operator interface devices 114 may include a throttle pedal 116 having a throttle position sensor (TPS) 118, and a gear selector lever 120 having a lever encoder 122.

Figure 2:
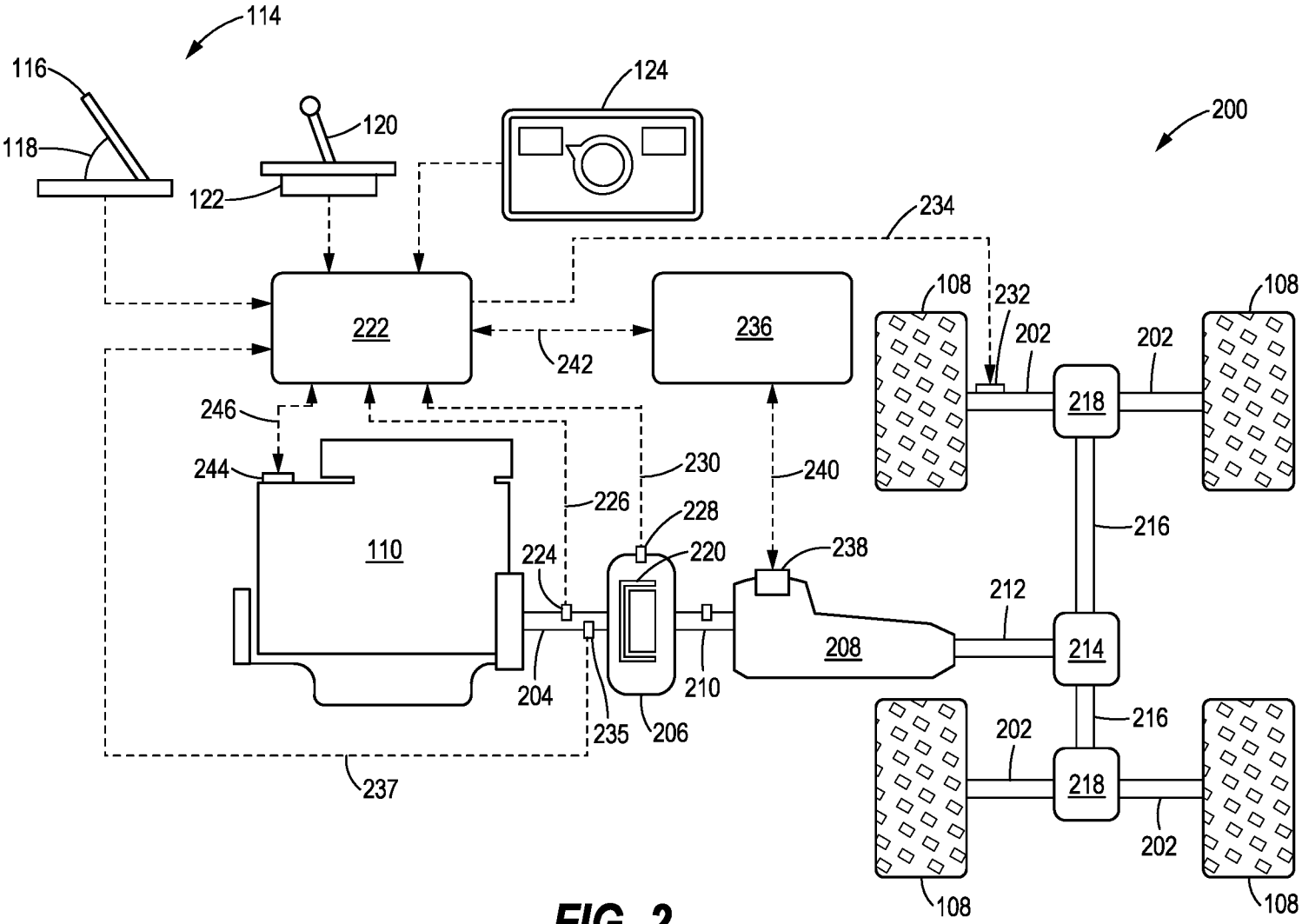
FIG. 2 is a schematic diagram of a powertrain of the work machine, according to an embodiment of the present disclosure.

Furthermore, FIG. 2 illustrates a schematic of a powertrain 200 associated with the work machine 100. Referring to FIGS. 1 and 2, the powertrain 200 may include respective axles 202 connected to the set of ground engaging elements 108. An engine output shaft 204 is connected to a torque converter 206, and the torque converter 206 is further connected to a transmission 208 via a transmission input shaft 210. Further, a transmission output shaft 212 is connected to a splitter 214 that powers two drive shafts 216, one for each of the axles 202. Each of the drive shafts 216 transmits power to the ground engaging elements 108 via respective differentials 218 such that rotational power produced at the engine output shaft 204 is transmitted to the ground engaging elements 108. The torque converter 206 may be a hydro-mechanical device configured to couple the engine 110 with the transmission 208. The torque converter 206 may include a lock-up clutch 220 for selectively coupling the engine output shaft 204 to the transmission input shaft 210. The lock-up clutch 220 may be hydraulically actuated. The work machine 100 may operate with or without a lock-up clutch 220. A person having ordinary skill in the arts would recognize that the work machine 100 may require a lock-up clutch 220 for some applications in the field of use and in other applications of the work machine 100 do not require a lock-up clutch 220. The work machine 100 may further comprise directional clutches and speed clutches.

The transmission 208 may embody a multi-speed, bidirectional, mechanical transmission having a neutral gear ratio, a plurality of forward gear ratios, and a plurality of reverse gear ratios. The forward gear ratios may include a first gear ratio and a second gear ratio. The reverse gear ratios may include a first reverse gear ratio and a second reverse gear ratio.

The TPS 118 and the lever encoder 122 are configured to provide a desired ground speed signal indicative of a desired machine speed and a current gear ratio setting of the transmission 208 that is commanded by an operator during the operation. The operator interface devices 114 may also include a selector interface 124 configure to select a manual mode or an automatic mode operation of the work machine 100. The selector interface 124 may embody a switch, a dial, a lever, a touch-based interface, or a voice-based interface or the like. One will recognize that the work machine 100 may be configured to operate only in automatic mode or be configured to selectively operate in either an automatic or manual made.

As shown in FIG. 2, a control system 222 is provided to regulate the operation of the powertrain 200. The control system 222 may be an electronic controller that may include a processor operably associated with other electronic components such as data storage devices and various communication channels. The control system 222 is connected to an engine output shaft speed sensor 224 via an engine speed communication channel 226, a torque converter locked state sensor 228 via a torque converter communication channel 230, a ground speed sensor 232 via a ground speed communication channel 234, and an inclinometer sensor 235 via a machine grade communication channel 237. The inclinometer sensor 235 is configured to provide a machine grade percentage or inclination of the work machine 100 while on ground level or a sloped ground while the work machine 100 is moving in reverse or forward motion. The slope may be an inclined or declined slope.

The control system 222 may regulate the operation of the powertrain 200 in response to signals indicative of the operation of the powertrain 200 as well as the signals received from the operator interface devices 114, such as the TPS 118, the lever encoder 122, and the selector interface 124. The selector interface 124 may also be configured to display the current machine conditions received by the control system 222 through the various communication channels.

The powertrain 200 may further include a transmission controller 236, which is configured to control the operation of the transmission 208. The transmission controller 236 is connected to a transmission interface 238 via a transmission communication channel 240. The transmission interface 238 may include a data structure that can selectively engage the transmission 208 in the first gear ratio or the second gear ratio in response to a command from the transmission controller 236. The transmission interface 238 may also provide information to the transmission controller 236 indicative of the current gear ratio setting as well as other information, such as the power transmitted to the ground engaging elements 108 through the transmission 208, the speed of the transmission output shaft 212, the speed of the transmission input shaft 210, the machine grade percentage from the inclinometer sensor 235, the engagement status of the lock-up clutch 220, and the like. In the illustrated embodiment, information may be exchanged between the control system 222 and the transmission controller 236 via a data bus 242. However, it should be appreciated that although the control system 222 and the transmission controller 236 are shown as separate components they may alternatively be integrated into a single control unit. For example, a master controller may be operatively implemented within an engine control unit (ECU), used to control the engine 110. The functionality of these devices, while shown conceptually in FIG. 2 that include various discrete functions for illustrative purposes only, may be implemented in hardware and/or software without regard to the discrete functionality shown. Accordingly, various interfaces of the control system 222 and the transmission controller 236 are described relative to the other components of the powertrain 200 in FIG. 2, which follows such interfaces, are not intended to limit other type of components.

According to an embodiment of the present disclosure, the control system 222 is configured to send a speed command signal to an engine interface 244 associated with the engine 110 via an engine communication channel 246 based on an activation signal received from the selector interface 124 indicative of the automatic mode operation of the work machine 100. The speed command signal may limit the engine speed at the engine output shaft 204 below a first engine speed limit. The first engine speed limit may be a transmission requested engine speed limit (TRESL) and may lie in a range of about 1400 rpm to 1600 rpm. The first engine speed limit is 1400 rpm. However, it will be apparent to a person having ordinary skill in the art that the first engine speed limit may vary based on the application and size of the engine 110 and the transmission 208. Further, the speed command signal may be based on the current gear ratio setting of the transmission 208 received and processed by the control system 222 via the transmission controller 236. The speed command signal may be transmitted when the gear ratio setting of the transmission 208 and current machine conditions is indicative of the second gear ratio, while on an inclined or declined slope or while on ground level. As described above, the control system 222 is configured to receive a ground speed signal from the ground speed sensor 232 via the ground speed communication channel 234. The first engine speed limit may also be based on the ground speed signal, such a machine speed in the second gear ratio of the transmission 208 is below a ground speed limit. The ground speed limit is 4.0 mph. The signals received by the control system 222 may be provided continuously during operation of the work machine 100.

The control system 222 may be further configured to receive the machine grade percentage of the work machine 100 on a certain grade level. The machine grade signal may be transmitted continuously from the inclinometer sensor 235 via the machine grade communication channel 237. It will be recognized that there may be a plurality of inclinometer sensors 235 provided on the work machine 100. The control system 222 determines execution of the directional shift and speed shift simultaneously for the optimal gear for the next pass or desired in response to the current conditions of the work machine 100 including torque converter output speed, torque converter output torque, gear, lock-up clutch engagement, and machine grade percentage. The simultaneous directional and speed shifts are executed using the current conditions of the work machine 100 and optimized for increasing fuel economy, increasing productivity, increasing efficiency, and decreasing component wear, while maintaining the same fuel rate. When the control system 222 executes the directional shift and speed shift at the same time, the directional clutches absorb a majority of the engagement energy which results in less wearing of the speed clutch.

The control system 222 is also configured to shift gear ratio settings of the transmission 208 during the automatic mode operation of the work machine 100. The gear ratio settings of the transmission 208 may be activated through the torque converter 206 either in a converter-drive operating mode ("CD") or in a direct-drive operating mode ("DD"), when the lock-up clutch 220 is in a locked position. During the automatic mode operation of the work machine 100, the control system 222 may command the torque converter 206 to remain in the direct-drive mode (DD) while the transmission 208 shifts from the first gear ratio to the second gear ratio. Moreover, an up-shift and a down-shift sequences for the powertrain 200 during the automatic mode operation of the work machine 100 may be:

1CD→1DD→2CD→2DD (during up-shift)

2DD→2CD→1DD→1CD (during down-shift)

where the numbers 1-2 represent the first gear ratio and the second gear ratio settings of the transmission 208, "CD" represents the converter-drive mode of the torque converter 206, and "DD" represents the direct-drive mode of the torque converter 206. Moreover, an additional down-shift sequences for the powertrain 200 is permitted during the automatic mode operation of the work machine 100 such as:

2DD→2CD→1CD (during down-shift)

During the up-shift in the automatic mode operation of the work machine 100, the shift in the gear ratio settings of the transmission 208 from 1DD→2DD may occur at a substantially full throttle position. A throttle position signal is configured to be received by the control system 222 from the TPS 118 associated with the throttle pedal 116.

The control system 222 uses the current machine conditions, including torque converter output speed and torque, gear, lock up clutch engagement, and machine grade percentage, to determine the optimal gear for the next pass and then command a gear when a change in directional speed or clutch engagement occurs. The control system 222 is configured to calculate the speed and torque thresholds in each gear while the work machine 100 is on a slope by calibrating the machine grade percentage of the sloped ground received by the inclinometer, while the work machine 100 moves in either forward or reverse gears. The torque converter output speed and torque converter output torque are then used to determine the speed and torque thresholds to be used in the next state flow. When above a certain speed and torque threshold, the control system 222 will command an upshift by executing a directional clutch shift and speed clutch shift simultaneously. When performing a directional shift while on a sloped surface, the directional shift or directional clutch and the necessary speed shift or speed clutches may be executed at the same time. By executing the directional shift and speed shift simultaneously while on a sloped surface, the directional clutch may absorb the engagement energy resulting in less wearing of the speed clutch. Each directional shift in the multi-pass sequence increases fuel economy and decreases wear on components during shifting.

In another embodiment, in the manual mode operation of the work machine 100, while shifting the gear ratio settings of the transmission 208 from direct-drive mode first gear ratio (1DD) to the second gear ratio, the control system 222 is configured to automatically lock the lock-up clutch 220. Thus, achieve 1DD→2DD shift in the gear ratio settings of the transmission 208 during the up-shift in the manual mode operation of the work machine 100.

Moreover, the control system 222 is also configured to limit the engine speed from passing a second engine speed limit. The second engine speed limit may be a threshold engine speed to restrict an uncontrolled increase in the engine speed, leading to a mechanical failure. The control system 222 may receive an engine speed signal from the engine output shaft speed sensor 224 via the engine speed communication channel 226, and monitor for an over-speed condition of the engine 110. Based on the over-speed condition of the engine 110, the control system 222 may further regulate the air/fuel supply to control the engine speed below the second engine speed limit, while on a slope or at ground level.

Furthermore, it will be apparent to a person having ordinary skill in the art that the control system 222 may further be operating in conjunction or cooperation with other control schemes or algorithms, which are not shown for simplicity. Relative to the present disclosure, the control system 222 operates to select an appropriate set of engine power curves depending on the operating conditions of the engine 110, the torque converter 206 and the transmission 208, while on a slope or at ground level.

INDUSTRIAL APPLICABILITY

In operation, the present disclosure may find applicability in many industries including, but not limited to, the mining, construction, earth-moving, industrial, and agricultural industries. While the foregoing detailed description is made with specific reference to landfill compactors, it is to be understood that its teachings may also be applied onto any type of work machine such as, but not limited to, backhoes, cranes, skid steers, wheel loaders, tractors, and mulchers, and the like, may embody the disclosed systems and methods, for performing at least one operation associated with mining, construction, and other industrial or non-industrial applications. The industrial applicability of the systems and methods for controlling a powertrain having a torque converter connected to a transmission in a machine described herein will be readily appreciated from the foregoing discussion.

In accordance with an embodiment of the present disclosure, largely, the operating performance of a machine such as, material compaction performance in case of the landfill compactor, is based on the machine speed of the machine and a rolling resistance experienced by the machine, taking into consideration the inclination of the ground. Typically, engine load/power of the machine is controlled based on the machine speed and the rolling resistance experienced by the machine to achieve an optimal operating performance. Moreover, the machine speed is required to be maintained below a ground speed limit to achieve the optimal operating performance. Usually, to achieve the optimal operating performance and the fuel efficiency, the machine is operated in the second gear ratio of the transmission with a converter-drive mode of the torque converter to maintain the machine speed below the ground speed limit. However, the torque convertor may be overheated due to continuous working cycles of the machine in the first or second gear ratio with the converter-drive mode. This may adversely affect a lifetime of the torque convertor and reduce the performance of the overall powertrain. By utilizing the inclinometer sensor 235, the performance of the powertrain in the work machine 100 may increase the efficiency, productivity, and fuel economy, decrease the wear on components for shifting, and improving upshifting and downshifting commands by the control system 222. The inclinometer sensor 235 provides the machine grade percentage to the control system 222 for better optimized gear shifting commands which aids in increasing the productivity, efficiency, and fuel economy utilizing the same fuel rate.

The control system 222 may limit the engine speed below the pre-determined speed (TRESL) in the second gear ratio of the transmission 208 and select the torque converter 206 in the direct-drive mode (DD) to achieve a desired machine speed while operating. Advantageously, the control system 222 may achieve fuel efficiency by operating in the second gear ratio, optimal operating performance by maintaining the desired machine speed, and avoid overheating of the torque converter 206 by remaining in the direct-drive mode (DD) while in the second gear ratio.

Figure 3:
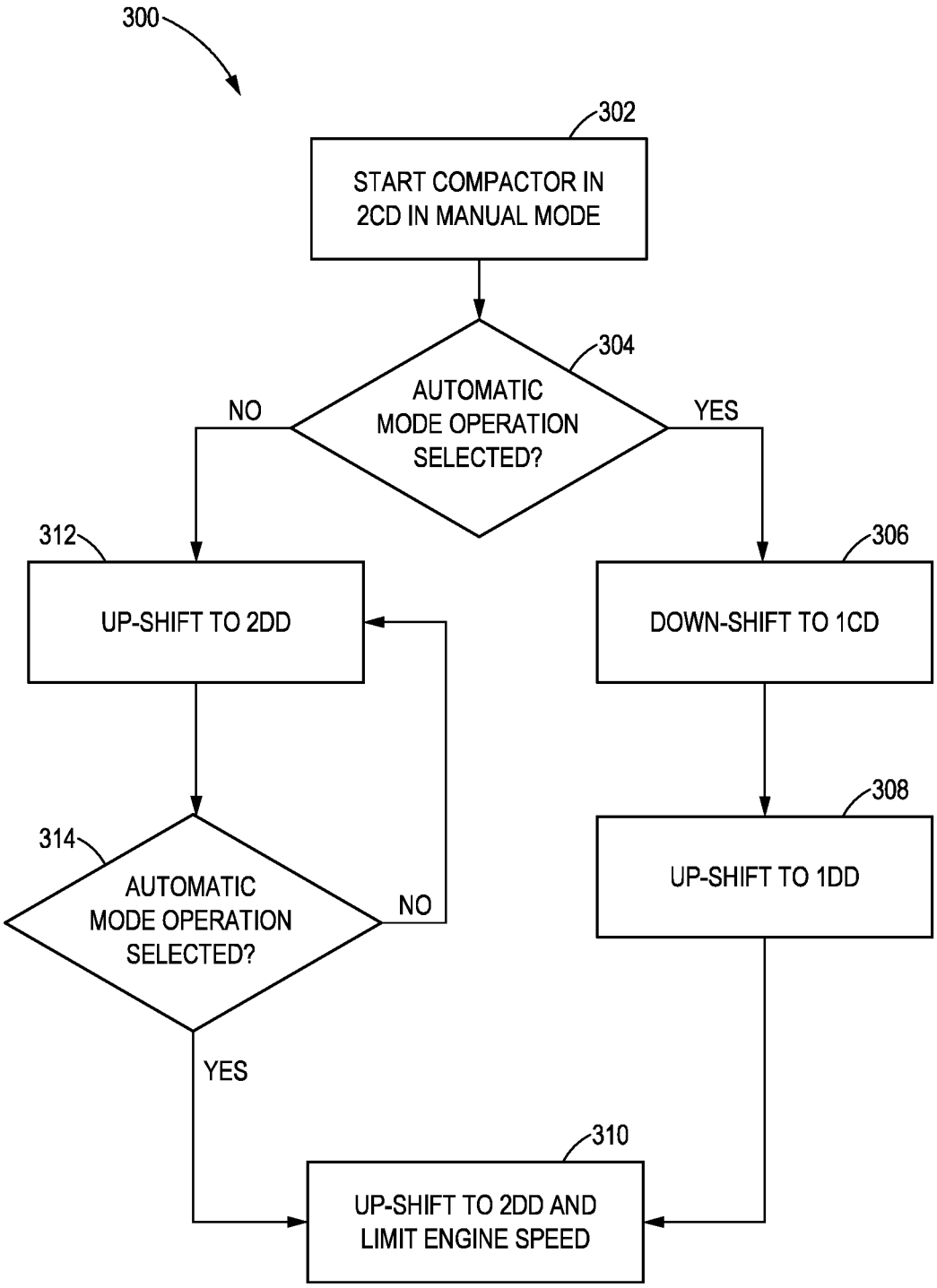
FIG. 3 is a flowchart for an exemplary transmission transition strategy in the work machine, according to an embodiment of the present disclosure.

FIG. 3 illustrates a flowchart for an exemplary transmission transition strategy 300 in the work machine 100, in accordance with one embodiment of the present disclosure. At step 302, an operator may start the work machine 100 in the converter-drive mode second gear ratio (2CD) to initiate compaction process. At step 304, the operator may select the automatic mode operation of the work machine 100, if the automatic mode operation is selected (Step 304: YES), the control system 222 may down-shift the powertrain 200 to the converter-drive mode first gear ratio (1CD) at step 306. Following step 306, the control system 222 may up-shift the powertrain 200 to the direct-drive mode first gear ratio (1DD) at step 308. The control system 222 may provide a delay of a pre-determined time during the up-shift from 1CD→1DD to minimize any undesirable loading/jerks. The pre-determined time may be in a range of about 2 seconds to 5 seconds. Further, as described above, at step 310, based on the machine speed and machine grade percentage associated with the work machine 100 and/or the throttle position signal, the control system 222 may up-shift the powertrain 200 to the second gear ratio of the transmission 208 while commanding the torque converter 206 to remain in the direct-drive mode. In the direct-drive mode second gear ratio (2DD), the machine speed associated with the landfill compactor may be limited below the ground speed limit while compacting the material. At step 310, the control system 222 may also limit the engine speed below the first engine speed limit to achieve the optimal compaction performance and the fuel efficiency in the work machine 100, while on a slope or ground level. At step 310, control system 222 may also monitor for an over-speed condition of the engine 110 and limit the engine speed from passing the second engine speed limit, while on a slope or ground level.

Moreover, if the automatic mode operation is not selected at step 304 (Step 304: NO), the control system 222 may up-shift the powertrain 200 to the direct-drive mode second gear ratio (2DD) based on an input from the operator, the inclinometer sensor 235, and the machine speed at step 312. In this mode, the work machine 100 may be primarily cruising without performing compaction of material. However, in the event an operator selects the automatic mode operation of the work machine 100 at step 314, the control system 222 go to step 310 by limiting the engine speed below the first engine speed limit to achieve the optimal compaction performance and fuel efficiency. In the automatic mode operation of the work machine 100, the control system 222 commands the gear shifts by considering the current machine conditions and the machine grade percentage. The control system 222 optimizes execution of each gear shift so that the directional shift and speed shift are executed simultaneously. When the directional shift and speed shift are executed simultaneously, the direction shift clutches absorbs a majority of the engagement energy which reduces the wear of the speed shift clutches.

Figure 4:
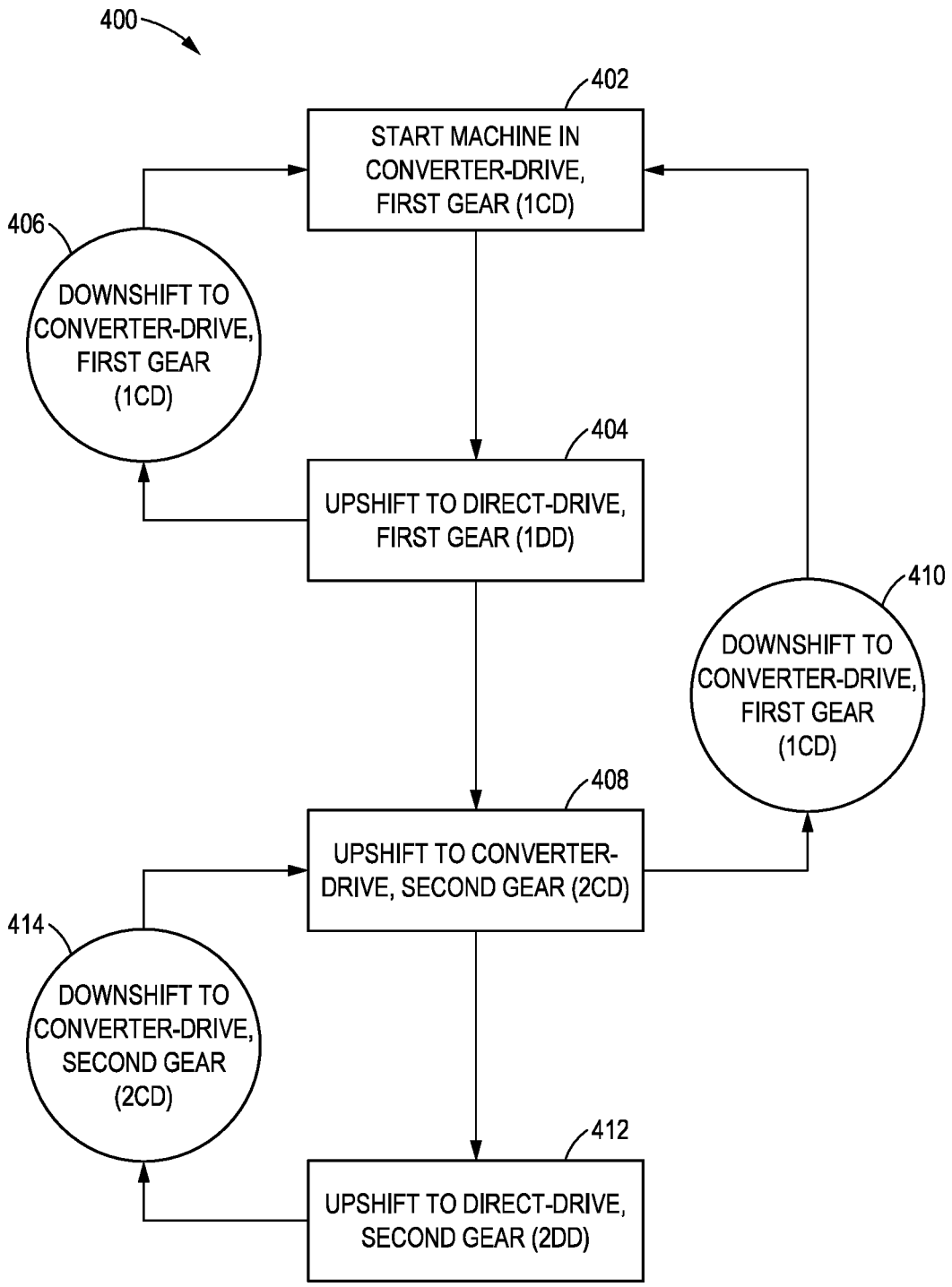
FIG. 4 is a flowchart for an exemplary forward gear shifting transmission transition strategy in the work machine, according to an embodiment of the present disclosure

FIG. 4 illustrates a flowchart for an exemplary transmission transition strategy 400 for forward gear shifts in the work machine 100, in accordance with one embodiment of the present disclosure. At step 402, an operator may start the work machine 100 in the converter-drive mode first gear ratio (1CD). At step 404, the operator may increase the throttle position so that the torque converter output speed increases above a torque converter output speed threshold, the control system 222 may up-shift the powertrain 200 to the direct-drive mode first gear ratio (1DD). The control system 222 may up-shift the powertrain 200 to the direct-drive mode first gear ratio (1DD) whereby the directional shift and speed shift are executed at the same time in automatic mode or when the operator performs the up-shift in manual mode. If provided, the work machine 100 may utilize the lock-up clutch 220 to aid during gear shifting. The control system 222 may provide a delay of a pre-determined time during the up-shift from 1CD→1DD to minimize any undesirable loading/jerks during gear shifting. The pre-determined time may be in a range of about 2 seconds to 5 seconds, in step 402. Furthermore, while in 1DD, the work machine 100 may decelerate so that the torque converter output speed decreases below a reverse torque converter output speed threshold, whereby the control system 222 down-shifts the powertrain 200 to the converter-drive mode first gear ratio (1CD), in a step 406. The control system 222 may provide a delay of a pre-determined time during the down-shift.

Following step 404, while in the 1DD the operator may accelerate the work machine 100 via the throttle pedal 116 so that the torque converter output speed increases above a second torque converter output speed threshold, the control system 222 may up-shift the powertrain 200 to the converter-drive mode second gear ratio (2CD), in a step 408. The control system 222 may up-shift the powertrain 200 to the converter-drive mode second gear ratio (2CD) whereby the directional shift and speed shift are executed at the same time in automatic mode or when the operator performs the up-shift in manual mode. If provided, the work machine 100 may utilize the lock-up clutch 220 to aid during gear shifting. The control system 222 may provide a delay of a pre-determined time during the up-shift from 1DD→2CD to minimize any undesirable loading/jerks during gear shifting. The pre-determined time may be in a range of about 2 seconds to 5 seconds, in step 404. Furthermore, while in 2CD, the work machine 100 may decelerate so that the torque converter output speed decreases below a reverse torque converter output speed threshold, whereby the control system 222 down-shifts the powertrain 200 to the converter-drive mode first gear ratio (1CD), in a step 410. The control system 222 may provide a delay of a pre-determined time during the down-shift.

Following step 408, while in the 2CD the operator may accelerate the work machine 100 via the throttle pedal 116 so that the torque converter output speed increases above a third torque converter output speed threshold, whereby the control system 222 may up-shift the powertrain 200 to the direct-drive mode second gear ratio (2DD), in a step 412. The control system 222 may up-shift the powertrain 200 to the direct-drive mode second gear ratio (2DD) whereby the directional shift and speed shift are executed at the same time in automatic mode or when the operator performs the up-shift in manual mode. The control system 222 may provide a delay of a pre-determined time during the up-shift from 2CD→2DD to minimize any undesirable loading/jerks during gear shifting. The pre-determined time may be in a range of about 2 seconds to 5 seconds, in step 406. Furthermore, while in 2DD, the work machine 100 may decelerate so that the torque converter output speed decreases below a third reverse torque converter output speed threshold, whereby the control system 222 down-shifts the powertrain 200 to the converter-drive mode second gear ratio (2CD), in a step 414. The control system 222 may provide a delay of a pre-determined time during the down-shift.

Figure 5:
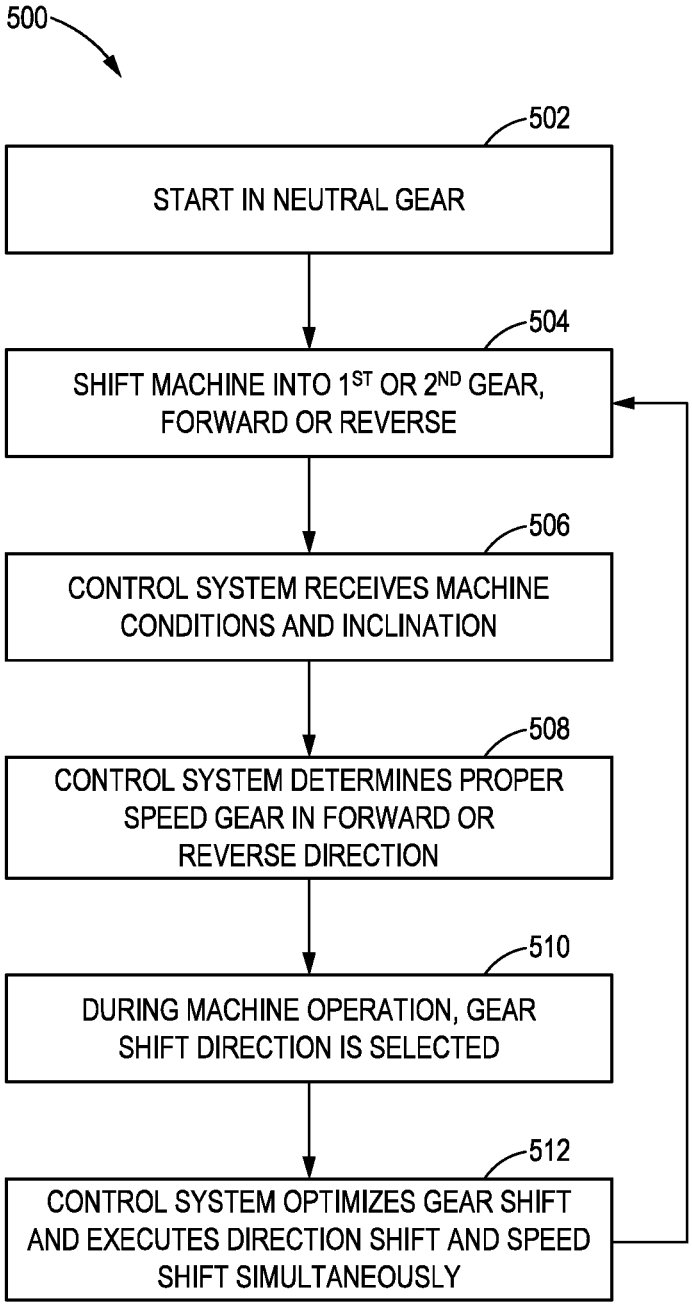
FIG. 5 is a flowchart for exemplary transmission transition strategy in the work machine considering machine conditions, according to an embodiment of the present disclosure The figures depict one embodiment of the presented invention for purposes of illustration only. One skilled in the art will readily recognize from the following discussion that alternative embodiments of the structures and methods illustrated herein may be employed without departing from the principles described herein.

Now referring to FIG. 5, illustrates a flowchart for an exemplary transmission transition strategy 500 in the work machine 100 considering the machine conditions and inclination, in accordance with one embodiment of the present disclosure. At a first step 502, the work machine 100 may start operation in a neutral gear. One will recognize that the machine may also start in any reverse, first, or second gear. At step 504, the work machine 100 shifts into first or second gear, in either forward or reverse. In a step 506, the control system 222 receives machine conditions including the machine speed, the torque converter output speed and torque, gear, lock up clutch engagement, and machine grade percentage. Next, in a step 508, the control system 222 determines the proper speed gear in forward or reverse direction. At a step 510, the control system 222 selects the gear shift direction. Alternatively, an operator in the work machine 100 may select the gear shift direction on the selector interface 124. The control system 222 optimizes the gear shift and executes both the directional shift and speed shift simultaneously, in a step 512. Returning to step 504, the machine shifts into the desired first or second gear, in forward or reverse direction, continuously repeating steps 506-512 during operation of the work machine 100 to optimize and improve the efficiency, productivity, and fuel economy of the work machine 100 as well as reducing the wear on the components during shifting.

From the foregoing, it can be seen that the technology disclosed herein has industrial applicability in a variety of settings such as, but not limited to work machines in the construction and agricultural industries. It will be appreciated that the foregoing description provides examples of the disclosed system and technique. However, it is contemplated that other implementations of the disclosure may differ in detail from the foregoing examples.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

What is claimed is:

1. A work machine comprising:

a powertrain;

an engine;

a torque converter operably connected to the engine;

a transmission;

a selector interface; and a controller configured to:

receive a machine activation signal from the selector interface indicative of operation of the work machine;

receive machine conditions to determine an optimal gear for next pass, the machine conditions include a torque converter output speed and a torque converter output torque; and send a gear pass signal to command execution of a directional shift and a speed shift simultaneously when a gear ratio setting of the transmission is indicative of a second gear ratio in forward and reverse gears.

2. The work machine of claim 1, wherein the controller is further configured to receive the gear ratio setting of the transmission from a transmission controller.

3. The work machine of claim 1, wherein the machine conditions include, a machine speed, a torque converter output torque, the gear, a lock-up clutch engagement, and a machine grade percentage.

4. The work machine of claim 1, wherein the controller is further configured to limit the engine speed from passing a second engine speed limit.

5. The work machine of claim 1 is a landfill compactor.

6. The work machine of claim 1 further includes a lock-up clutch.

7. The work machine of claim 1, wherein the directional clutch absorbs a majority of engagement energy during the simultaneous shift with the speed shift.

8. The work machine of claim 1, the selector interface is further configured to activate a manual mode operation or an automatic mode operation of the work machine.

9. A method for operating a work machine having a powertrain, the powertrain including an engine operably connected to a torque converter, the torque converter connected to a transmission, and a selector interface, the method comprising:

activating operation of the work machine via the selector interface;

receiving machine conditions by a control system to determine an optimal gear for next pass, the machine conditions include a torque converter output speed and a torque converter output torque; and sending a gear pass signal by the control system to command execution of a directional shift and a speed shift simultaneously when a gear ratio setting of the transmission is indicative of a second gear ratio in forward and reverse gears.

10. The method of claim 9 further comprises:

selecting the directional shift on the selector interface by an operator;

optimizing by the control system the gear pass signal after the operator selection; and executing the directional shift and the speed shift simultaneously.

11. The method of claim 9 further comprises receiving the gear ratio setting of the transmission from a transmission controller.

12. The method of claim 9 further comprises limiting the engine speed by the control system from passing a second engine speed limit.

13. The method of claim 9, the method further including displaying the machine conditions on the selector interface.

14. The method of claim 9 further includes absorbing a majority of the engagement energy via the directional clutch when gear shifting simultaneously with the speed shift.

15. The method of claim 9, the work machine further includes a lock-up clutch.

16. A work machine powertrain, the work machine powertrain comprising:

an engine operably connected to a torque converter, the torque converter connected to a transmission, and a controller:

the controller configured to:

receive powertrain conditions to determine an optimal gear for next pass wherein the powertrain conditions include a torque converter output speed, a torque converter output torque; and send a gear pass signal to command execution of a directional shift and a speed shift simultaneously when a gear ratio setting of the transmission is indicative of a second gear ratio in forward and reverse gears.

17. The work machine powertrain of claim 16, the powertrain comprising a lock-up clutch.

18. The work machine powertrain of claim 16, wherein the controller is further configured to receive the gear ratio setting of the transmission from a transmission controller.

19. The work machine powertrain of claim 16, wherein the powertrain conditions further include a gear, a lock-up clutch engagement status, and an inclination percentage.

20. The work machine powertrain of claim 16, wherein the directional clutch absorbs a majority of engagement energy during the simultaneous shift with the speed shift.

* * * * *